US005297601A

United States Patent [19]

Munsey et al.

[11] Patent Number: 5,297,601

[45] Date of Patent: Mar. 29, 1994

[54] TRIPLE HEAD HIGH SPEED LOG DEBARKER

[75] Inventors: Andy E. Munsey, LaGrande, Oreg.; Ralph R. Harvey, Post Falls, Id.

[73] Assignee: Pierce-Pacific Manufacturing, Inc., Tualatin, Oreg.

[21] Appl. No.: 27,150

[22] Filed: Mar. 4, 1993

Related U.S. Application Data

[63] Continuation-in-part of Ser. No. 850,483, Mar. 12, 1992, Pat. No. 5,247,977.

[51] Int. Cl.[5] ..... B27L 1/00; B27M 1/02

[52] U.S. Cl. ..... 144/208 F; 144/208 R; 144/246 R; 144/246 C; 144/246 F; 144/340; 144/341

[58] Field of Search ..... 144/208 R, 208 F, 246 R, 144/246 C, 246 E, 246 F, 340, 341

[56] References Cited

U.S. PATENT DOCUMENTS

| | | | |
|---|---|---|---|
| 1,373,243 | 3/1921 | Hellstrom . | |
| 2,498,786 | 2/1950 | Bouchard . | |
| 2,611,401 | 9/1952 | Burton . | |
| 2,698,036 | 12/1954 | Hilborn . | |
| 2,702,570 | 2/1955 | Rothrock . | |
| 2,945,523 | 7/1960 | Jenkins | 144/208 F |
| 3,263,720 | 8/1966 | Brock et al. | 144/208 F |
| 3,267,976 | 8/1966 | Keeney . | |
| 3,587,685 | 6/1971 | Morey | 144/208 F |
| 4,444,234 | 4/1984 | Arasmith . | |
| 4,540,031 | 9/1985 | Kvarnang . | |
| 4,875,511 | 10/1989 | Wingate-Hill | 144/208 F |
| 5,022,446 | 6/1991 | Wingate-Hill et al. | 144/208 F |
| 5,111,860 | 5/1992 | Wingate-Hill et al. | 144/208 F |
| 5,127,453 | 7/1992 | Wingate-Hill et al. | 144/208 F |

OTHER PUBLICATIONS

Peterson Model 4800-C Multiple Log Delimber/-Debarker, product brochure, Peterson Pacific Corp., Eugene, Oreg., Feb. 18, 1991.

Peterson Model DDL 5200, Flail Delimber/Debarker, product brochure, Peterson Pacific Corp., Eugene, Oreg., Nov. 11, 1991.

A5 Debarker, product brochure, Nicholson Manufacturing Company, Seattle, Wash.

Model 2202, Mechanical Debarker product brochure, Manitowoc Debarking Systems, Manitowoc, Wis., 1984.

Morbark Sawmill Supply, 628,640, C-Series Debarkers product literature.

*Primary Examiner*—W. Donald Bray

*Attorney, Agent, or Firm*—Marger, Johnson, McCollom & Stolowitz

[57] ABSTRACT

A log debarker for debarking a lengthwise-moving log includes a pair of debarking subassemblies each including a pair of cylindrically concave, rotating cutter elements positioned angularly asymmetrically toward one side of the log and away from an opposite side thereof and a third subassembly including a cutter element positioned to debark said opposite side of the log. Each of the pair of debarking subassemblies includes a stationary support frame, a tilting head platform and a pivoting cutter assembly supporting the cutter elements linked to the support frame so as to pivot the cutter element about an axis normal to the log axis as the cutter assembly is tilted. The cutter elements are moved toward or away from one another to adapt to different log diameters and are pivoted about an axis normal to their axes of rotation. Pivoting the cutter element skews the rotational axis of the concave cutting surface to an oval of a reduced effective radius of concavity in a plane normal to the log axis to debark a smaller diameter log. The cutter elements in the pair are pivoted in opposite directions so as to nest within one another and are counterrotated to negate turning of the log during debarking.

13 Claims, 5 Drawing Sheets

TRIPLE HEAD HIGH SPEED LOG DEBARKER

RELATED APPLICATION DATA

This application is a continuation-in-part of U.S. application Ser. No. 07/850,483, filed Mar. 12, 1992, now U.S. Pat. No. 5247977.

BACKGROUND OF THE INVENTION

This invention relates generally to machinery for removal of material from logs and more particularly to high speed log debarkers.

Debarkers are widely used in the forest products industry to remove bark from logs intended for many uses, including sawing into lumber, peeling for veneer, poles and posts, and for chipping. Most such apparatus are arranged to receive a whole log and to debark the entire length of the log in a single, parallel-type operation, essentially by rotating the log about its lengthwise axis in contact with a series of cutting elements disposed lengthwise along the log. Examples of this type of apparatus are shown in U.S. Pat. Nos. 2,498,786; 2,698,036; 2,611,401; 2,702,570; 3,267,976 and 4,444,234. This type of machine requires a very wide bed with many cutting elements to debark long logs. Alternatively, the logs must be limited in length. In either case, the debarking apparatus is very expensive and not readily portable.

The other type of debarker is arranged to feed a log lengthwise along a cutting element while rotating the log about its lengthwise axis, such as MORBARK Models 628 and 640. This type of debarker is less complex, not as expensive and log length is not a constraint as in the parallel-type debarkers referred to above. Its main drawback is that it is much slower. Examples of this type of debarker are disclosed in U.S. Pat. Nos. 1,373,243 and 4,540,031. A related type is the ring debarker, such as Nicholson Model A5 and Manitowoc Model 2202, which peels off the bark in a spiral fashion as the cutter head moves lengthwise along the log. Another type is the flail-type debarker, such as the Peterson Pacific Models 4800 and 5200, in which the log is moved lengthwise past two or four drums carrying whirling chains which flail the bark off a log.

As old growth forests no longer are available, and for economic reasons, it is becoming increasingly important to be able to use smaller diameter timber for many forest products applications. The main problem that results is that the yield of useful wood from smaller logs is less than in larger logs. It becomes necessary to cut and debark more smaller diameter trees to produce, for example, a given mass of wood chips than required for large diameter logs. Throughput of a debarker thus becomes a critical requirement.

At the same time, to reduce travel in hauling harvested logs to a debarker, it is preferable to be able to locate the debarker nearer the tree source and be able to move it when harvesting a distant stand of trees. The higher throughput ring-type debarkers are generally too big and complex to be readily disassembled and moved, and are too expensive to have many of them at dispersed locations. The latter, lengthwise-infeed type of debarker mentioned above is less expensive and more portable but not nearly as fast at debarking, so throughput for small-diameter logs is unsatisfactory.

Another concern, whichever type of debarker is used, is to be able to handle a wide range of log diameters. Conventional ring-type debarkers, commonly used in fixed installations in mills, are made to handle logs ranging in diameter from a maximum of 35 inches (90 cm.) down to 6 inches (15 cm.). They cannot debark smaller but usable logs or log ends which taper down to 3 inches (8 cm.) or less in diameter at their narrower end. These narrow logs must somehow be disposed of or discarded, presenting environmental concerns as well as wasting a substantial mass of fiber that would otherwise be useful at least as chips for pulp. A flail-type debarker, which can be portable, will handle a wide range of diameters but breaks up the smaller diameter ends, particularly if the wood is dry, again wasting much useful fiber. All available debarkers are very expensive—too much for low-value, small diameter logs that are not large enough to use as saw logs.

Accordingly, a need remains for a debarker that is more versatile, portable, and capable of high throughput but not prohibitively expensive.

SUMMARY OF THE INVENTION

It is, therefore, an object of the invention to enable small-diameter logs to be quickly debarked.

Another object of the invention as aforementioned is to economically debark a range of log diameters down to diameters of a few inches.

A further object of the invention is to debark small diameter logs with relatively inexpensive apparatus that is preferably portable and does not delay small diameter logs.

The invention is a high speed log debarker of the type that is arranged to debark a log moving lengthwise past a cutter element, employing a pair of debarking subassemblies which include a pair of cylindrically concave, rotating cutter elements juxtaposed on opposite sides of the log. The cutter elements are moved toward or away from one another to adapt to different log diameters. The cutter elements have cutting surfaces formed with a cylindrical arc of concavity defined axially of the cutter element by a cutter radius which determines a maximum diameter of log that can be debarked. As the cutter elements are moved toward one another, they are pivoted about an axis normal to their axes of rotation so as to nest within one another, and to define between the cutting surfaces an oval of a reduced diameter.

Each debarking subassembly includes a stationary support frame, a head platform and a pivoting cutter assembly supporting a rotating cutter element having a cylindrically concave cutting surface with a predetermined radius of concavity. The tilting head platform is movable, preferably by tilting about an axis parallel to the axis of the log, to move the cutter element toward or away from the log to adapt to different log diameters. The cutter assembly is pivotably mounted on the tilting head platform and linked to the support frame so as to pivot the cutter element about an axis normal to and intersecting the axis of the log as the cutter assembly is tilted toward the log. Pivoting the cutter element skews the rotational axis of the concave cutting surface to a reduced effective radius of concavity in a plane normal to the log axis for debarking a smaller diameter log.

Each debarking subassembly is capable of debarking somewhat more than one quadrant of a log. A first pair of such subassemblies juxtaposed on opposite sides of a log will debark two opposite quadrants of the log in a single pass. A second pair of such juxtaposed subassemblies, positioned coaxially of the first pair but rotated 90° about the log's axis will debark the remaining opposite quadrants of the log. The pairs of debarking subassemblies are preferably mounted on opposite sides of a frame so that their cutter elements are coaxially aligned with a log infeed axis for operation but can be swung laterally away from one another to a position way from the infeed axis for maintenance.

An alternative embodiment of debarker, using just three cutter assemblies, can be used in applications in which a small amount of residual bark can be tolerated. This embodiment uses a first pair of subassemblies, operable as described above but arranged to debark two quadrants angularly spaced asymmetrically about the log's axis to one side of the log. A third cutter element is positioned along the opposite side of the log at a location space axially from the first pair. In this arrangement, the three cutter assemblies each debark nearly a third of the side of the log.

The foregoing and other objects, features and advantages of the invention will become more readily apparent from the following detailed description of a preferred embodiment of the invention which proceeds with reference to the accompanying drawings.

DETAILED DESCRIPTION

Figure 1:
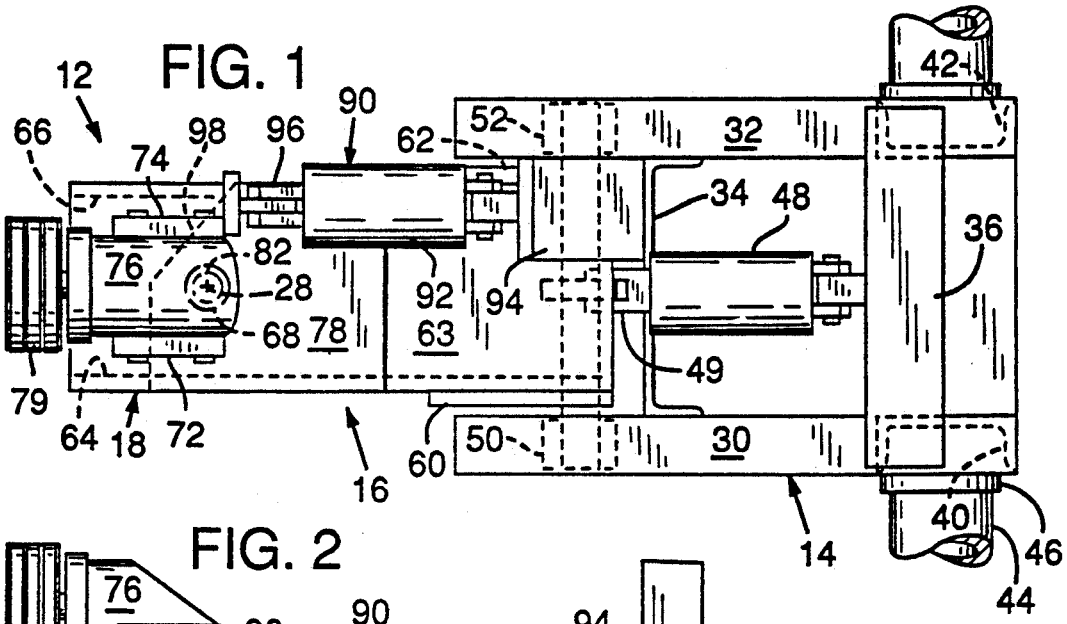
FIG. 1 is a top plan view of a single debarking subassembly according to the invention.
Figure 2:
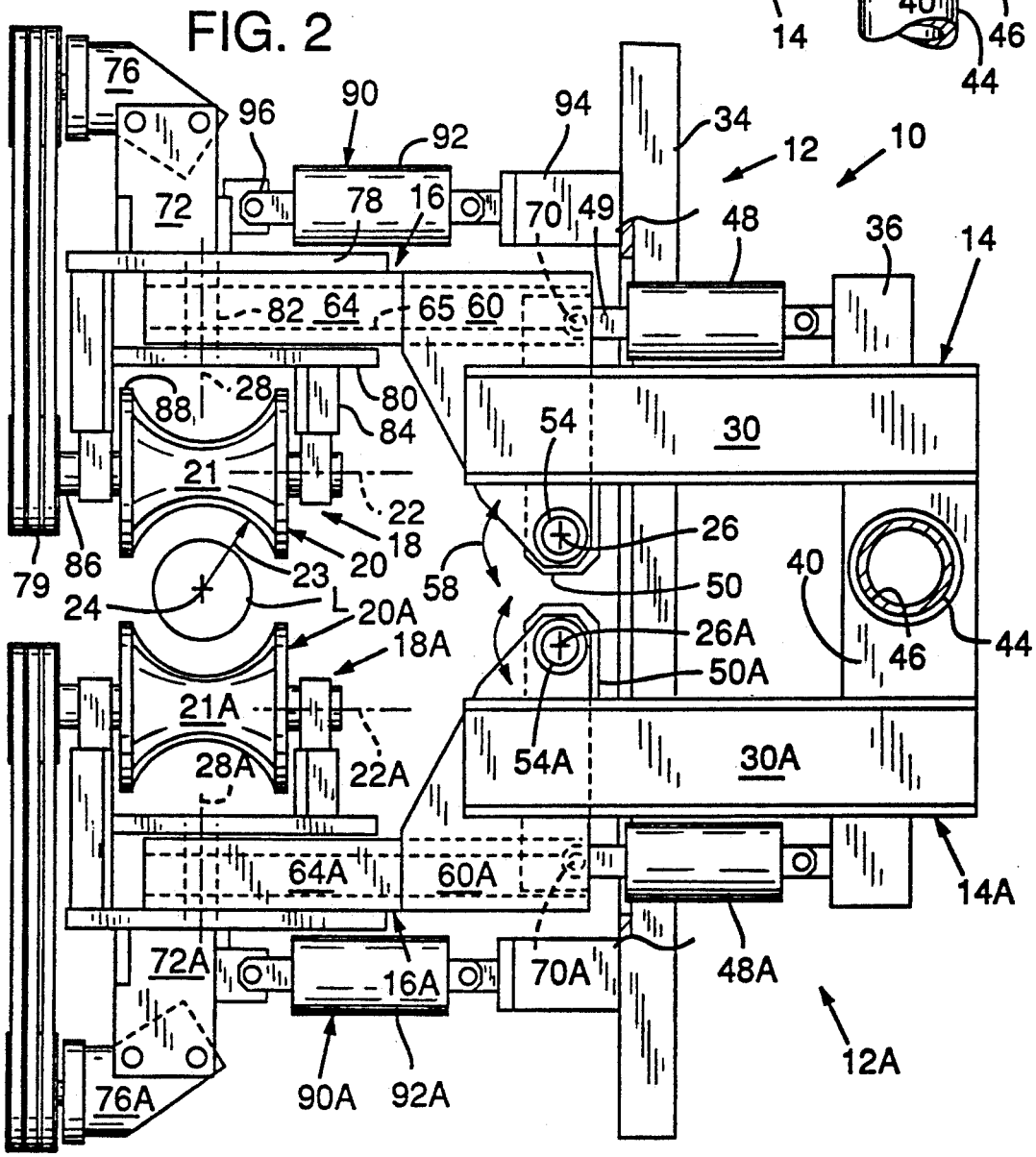
FIG. 2 is an elevation view of a pair of debarking subassemblies of FIG. 1, juxtaposed about a log L shown in cross section for infeeding lengthwise between cylindrically concave, rotating cutting elements positioned at a maximum spacing.

Referring to FIGS. 1 and 2, a debarker 10 according to the invention employs a pair of debarking subassemblies 12, 12A juxtaposed about opposite sides of a log L infed lengthwise between the subassemblies to debark two opposite quadrants of the log in a single pass. Each debarking subassembly is like the other and includes a stationary support frame 14, a tilting head platform 16 and a pivoting cutter assembly 18 (frame 14A, platform 16A and assembly 18A in subassembly 12A). The cutter assemblies include a pair of cutter elements or drums 20 juxtaposed on opposite sides of the log L and counterrotating on axes 22 normal to the axis 24 of the log. The cutter elements have cylindrically concave cutting surfaces 21 having radii of curvature 23 which coact as further described below. A second pair of juxtaposed subassemblies 112 (see FIGS. 5 and 6) and are positioned coaxially downstream or upstream of the first pair but rotated 90° about the log's axis 24 to debark the remaining opposite quadrants of the log.

The head platforms 16 are tiltable about axes 26 parallel to the axis of log L to move the cutter elements 20 toward or away from one another to adapt to different log diameters. The cutter assemblies 18 are pivotable about axes 28 normal to and intersecting the axis 24 of the log. As the cutter elements are moved toward one another by tilting of the head platforms 16, the cutter assemblies 18 are pivoted about axes 28 so as to nest the cutter elements 20 within one another, as described further in connection with FIGS. 4A, 4B and 4C. The cylindrically concave cutting surfaces thereby define between the cutter elements an oval of lesser diameter than the maximum diameter log that can be debarked by cutter elements of a given radius.

The stationary support frame 14 is a three-dimensional, rectangular structure, comprising a pair of spaced parallel side beams 30, 32 (30A, 32A in subassembly 12A). The side beams are rigidly interconnected and spaced apart by a vertical channel member 34 and box beam 36. Upper and lower side beams 30, 30A are vertically interconnected by an upright channel member 40 as well as channel member 34. A channel member 42 similarly vertically interconnects side beams 32, 32A. The frame 14 is mounted on an elongated, horizontal, cylindrical drum 44, 44A (FIG. 6) received in cylindrical opening 46 in upright members 40, 42.

A hydraulic or pneumatic ram 48 is connected at one end to box beam 36, centered between side beams 30, 32 and oriented to extend and retract in a direction parallel to side beams 30, 32. A pair of horizontal pivot mounts 50, 52 depend from the distal ends from side beams 30, 32. Similarly, mounts 50A, 52A protrude upward from the lower pair of side beams 30A, 32A in mirror-image relationship to mounts 50, 52. A cylindrical pivot member 54 extends horizontally in between mounts 50, 52 and has its ends journaled in the mounts. The pivot mounts 50, 52 and pivot member 54 tiltably support head platform 16 so that the platform can tilt about axis 26, as indicated by arrow 58, when the extensible end 49 of ram 48 extends or retracts.

The tilting head platform 16 includes a pair of vertically spaced apart parallel mounting plates 60, 62, pivotally mounted on pivot member 54 and supporting a rectilinear frame formed by welding a pair of spaced apart, parallel top and bottom plates 63, 65 perpendicularly to a pair of spaced apart, parallel side plates 64, 66. A cylindrical tube and bushing structure 68 is mounted in coaxial holes in top and bottom plates 63, 65 for supporting a cylindrical pivot member 82, which supports the pivoting cutter assembly 18 for rotation about axis 28, as further described below. The push rod of ram 48 is pivotally connected to platform 16 by means of a mounting bracket (not shown) between plates 63, 65 and pivot pin 70 oriented parallel to pivot member 54. The overall structure of platform 16 is, in elevation view, a generally L-shaped structure with pin 70 at the apex of the two legs of the platform, pivot 54 at the end of the shorter leg of the platform, and side plates 64, 66 together with top and bottom plates 63, 65 forming the longer leg of the platform.

The cutter assemblies 18 each include a pair of spaced parallel plates 78, 80 mounted on opposite ends of pivot member 82, spaced above and below top and bottom plates 63, 65 and supported for low-frictional angular movement thereon by ultra-high molecular weight (UHMW) pads (not shown) sandwiched between the top plates and the bottom plates. Cutter drive mounting plates 72, 74, extending upright from top plate 78 (and similarly depending from bottom plate 78A) serve as a motor mount for cutter drive motor 76. A similar mount on subassembly 12A mounts motor 76A. The motors can be either hydraulic motors, which is preferred for portable field use, or electric motors if AC power is available. These motors drive the cutter assemblies, further described below, through belt pulleys 79.

Each cutter assembly includes a pair of journaled mounts 84 extending normal to plates 79, 80, supporting cutter shaft 86 for rotation about axis 22 when driven by motor 76 via pulley arrangement 78. Drum-type cutter element 20 is mounted on shaft 86. The cutter element has a cylindrically concave surface 21 with a cylindrically concave contour defined axially between opposite rims 88 by a circular arc of a predetermined radius 23, for example of 6 inches (15 cm.). The cylindrically concave cutting surface can be formed by knives, abrasion bars or a combination of both, or of other concavely formed cutting surfaces, depending on the needs of each application.

A linkage assembly 90 connects the cutting assembly 18 to support frame 12 so as to pivot the cutting assembly as a unit about axis 28 whenever platform 16 is tilted about axis 26 to move the cutter element 20 toward or away from a log. The linkage assembly includes a pneumatic or hydraulic ram 92, coupled at one end to a mounting block 94, which is mounted on the support frame 12, preferably to channel member 34 and offset toward side beam 32. The opposite, extensible end 96 of ram 92 is connected by lever arm 98 mounted on plate 78 to pivot the cutter assembly. The manner of operation of debarker 10 to adapt the subassemblies 12, 12A to debark different diameters of logs is next described.

OPERATION

FIG. 2 shows debarker 10 with the subassemblies 12, 12A, positioned for debarking a log of maximum diameter, e.g. 12 inches (30 cm.). That is, rams 48, 48A are fully retracted so that axes 22, 22A of the cutter elements are parallel and the cutting faces 21, 21A are positioned at a maximum spacing apart.

Figure 3:
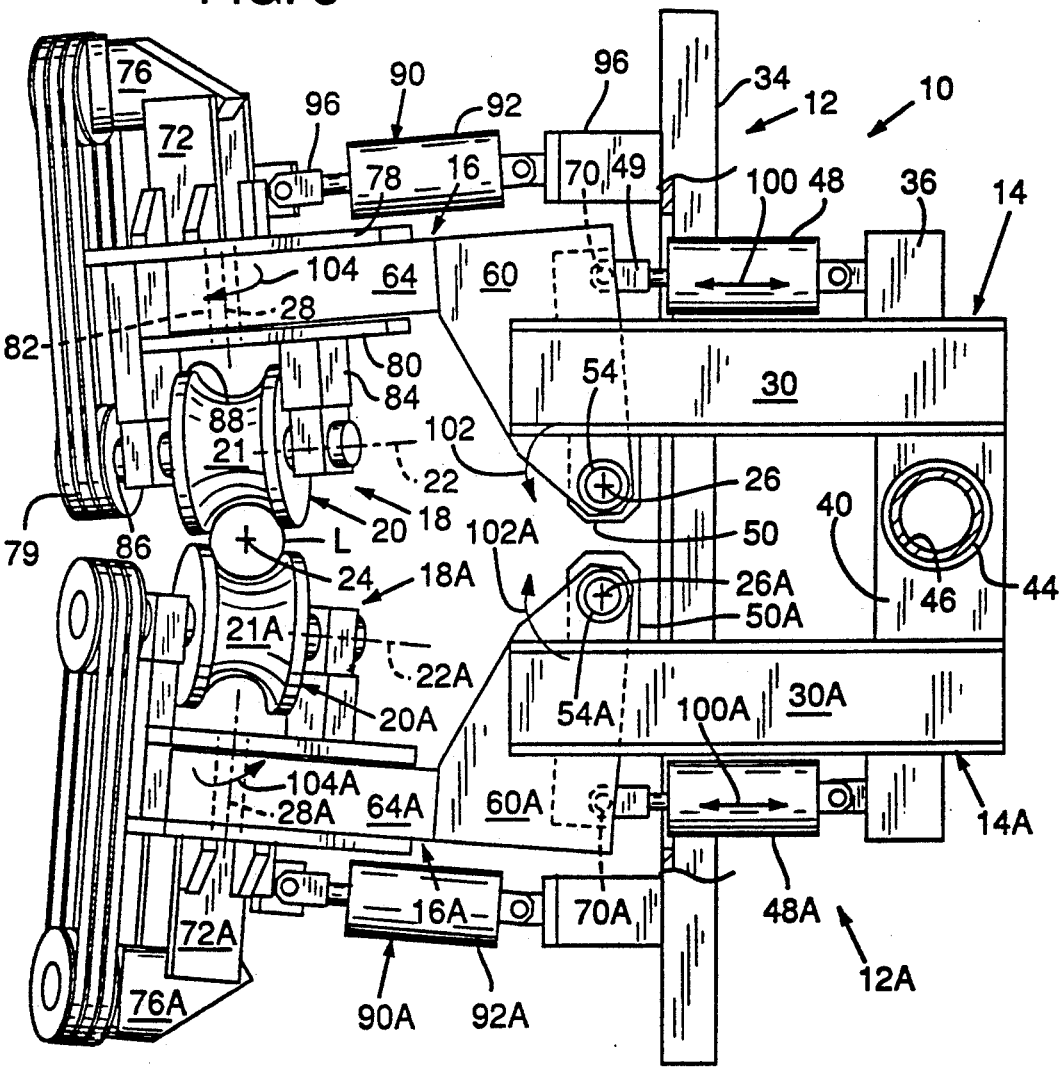
FIG. 3 is an elevation view like FIG. 2 but with the debarking subassemblies tilted toward one another to position the cutting elements at a reduced spacing for debarking a smaller diameter log.

FIG. 3 shows the debarker 10 with the subassemblies 12, 12A, repositioned so that the cutter elements 21, 21A form a reduced effective diameter for debarking a smaller log. In this case, rams 48, 48A are extended, as indicated by arrows 100, 100A to tilt the head platforms 16 inward about axis 26, as indicated arrows by 102, 102A. This action positions the cutting elements 20, 20A closer together. As the head platforms are tilted toward the log, the linkage assembly 90 restrains lever arm 98, causing cutter assembly 18 to pivot slightly about axis 28, as indicated by arrow 104. Tilting the juxtaposed subassembly 12A toward the log in the same fashion causes the cutter assembly 18A to pivot by the same angular amount in the opposite direction as indicated by arrow 104A.

The effect of pivoting each of the cutter elements is to change the composite profile of the cutting surfaces 21, 21A to an oval or ellipse having an effective radius in a plane normal to axis 24 of the log that is less than the actual radius of concavity of the cutting surface 21 along the axis 22 of the cutting element. The cutter drive motors counterrotate the cutter elements to avoid turning the log on its axis 24 while being debarked when the cutter elements are pivoted away from an axis normal to the axis of the log.

Figure 4C:
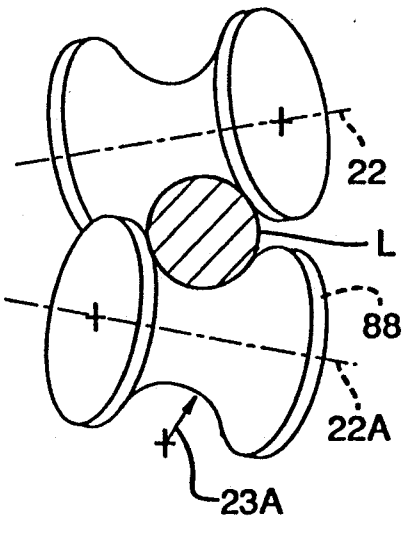
FIGS. 4A, 4B and 4C are diagrams showing a pair of juxtaposed cutting elements positioned at different spacings and angles in accordance with the invention for debarking logs of different diameters.
Figure 4B:
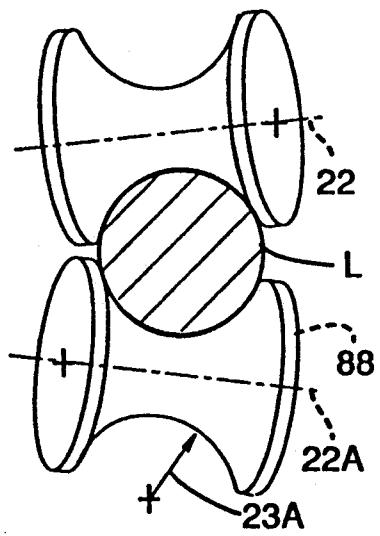
Figure 4A:
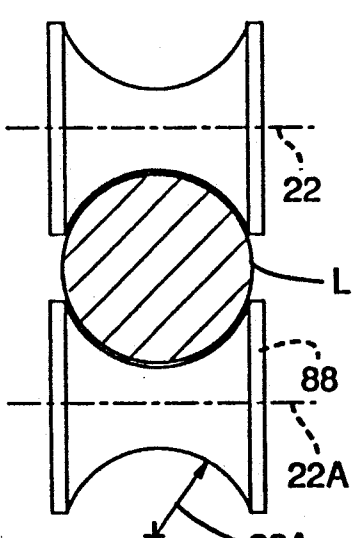

FIGS. 4A, 4B and 4C show how the effective radii 23A, 23B and 23C of the cutter elements can be reduced to debark smaller diameter logs by tilting the cutter elements closer together and pivoting the cutter assemblies about axes 28, 28A normal to axis 24 of the log. Pivoting the cutter assemblies 18, 18A in opposite directions, as indicated by arrows 104 and 104A in FIG. 3 enables one cutter element to nest within the other as they are moved toward one another. This avoids any interference between the rims 88 of the counterrotating cutter surfaces.

Figure 5:
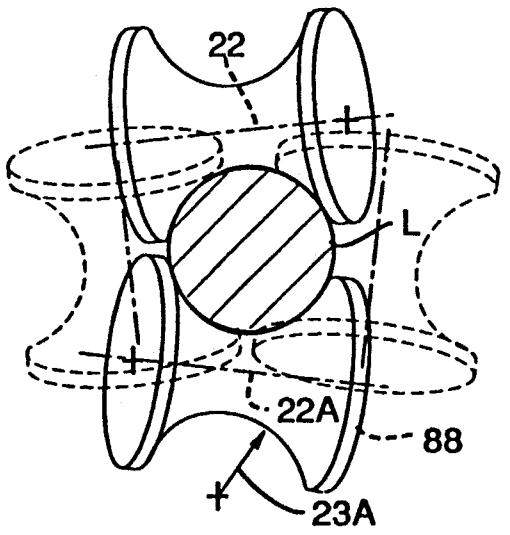
FIG. 5 is a diagram showing two pairs of cutting elements positioned coaxially for debarking four quadrants of logs of different diameters in accordance with the invention.

FIG. 5 shows how two pairs of cutter elements coact to debark the entire circumference of a log infed axially between the cutter elements. Each cutter element debarks somewhat more than a quadrant of the log. The amount of material removed by each cutter element will be determined by the operator and depend on the use to be made of the debarked log. For pulp chips, it is important to minimize the amount of bark left on the log. Some tradeoff can be made between the extent of overlap of adjacent cutter elements and the amount of wood removed by each cutter element. Two pairs of cutter elements having a cutting surface radius of 6 inches (15 cm.) will debark logs having a maximum diameter of 12 inches (30 cm.) down to a diameter less than 2 inches (5 cm.).

Figure 6:
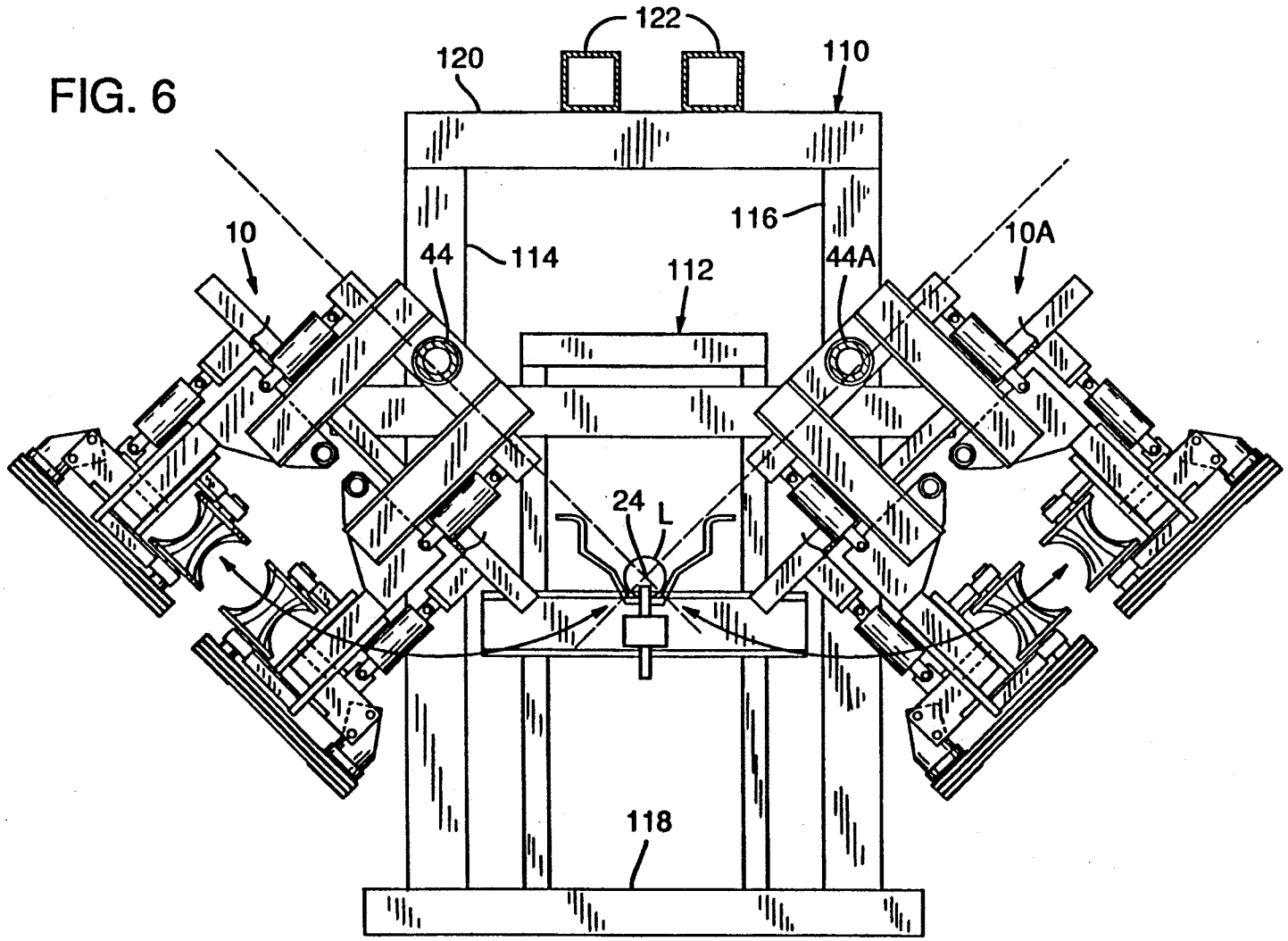
FIG. 6 is a end elevation view of two pairs of debarking subassemblies of FIG. 1 mounted on opposite sides of a support frame so that the subassemblies can be swung laterally away from the infeed axis of a conveyor for maintenance.

FIG. 6 shows a preferred manner of mounting two debarker assemblies 10, 10A, each including a pair of subassemblies 12, 12A as described above, on a support frame 110 so as to be positioned axially in line with an infeed conveyor 112. The support frame includes two pairs of upright members 114, 116 (one pair not shown) spaced apart about the infeed conveyor and interconnected by bottom and top lateral structural members 118, 120 and longitudinal top beams 122. Two cylindrical support drums 44, 44A extend parallel to the infeed axis 24 of the conveyor between the upright members for supporting the pairs of subassemblies. The support drums are positioned such that the cutter elements of the subassemblies are supported coaxially with one another and the log infeed axis 24 during debarking operation but can be swung laterally on the longitudinal support drums 44 away from the conveyor infeed path for maintenance.

Hydraulic rams 48, 48A are actuated from a common hydraulic pressure circuit (not shown) with a conventional reversible valving that permits both rams to be simultaneously extended or retracted by the same amount. Position sensors can be used on the rams or support platforms to provide feedback control. The hydraulic control valve can be either manually or automatically actuable in response to the diameter of a log.

The linkage rams 92 can be either pneumatic cylinders with a fixed charge of air pressure that permits a degree of extension that is less than the change in spacing between pivot arm 98 and the stationary frame 14. Alternatively, a hydraulic ram can be used together with a pressurized accumulator, or the linkage 90 can be a coil spring. The main advantage of using pneumatic cylinders is that it permits the charge of air pressure to be adjusted to ambient conditions for closer control of the retarding force exerted to pivot the cutter assemblies as the platform is tilted.

Besides the particular structure shown in the above-described preferred embodiment, the head platforms can be mounted so as to move translationally rather than pivotally toward and away from one another. It is also possible to implement the invention with one stationary and one tiltable or otherwise movable platform. Similarly, pivoting of the cutter assemblies in opposite directions, as the subassemblies are moved toward or away from one another, can be actuated by other means for coupling the rotation thereof to the movement of the head platforms, such as mechanical gearing, electric servo-motors, or direct hydraulic or pneumatic linear actuators in controlled parallel operation with, or responsive to, tilt rams 48 or equivalent translational actuation and devices.

Figure 7:
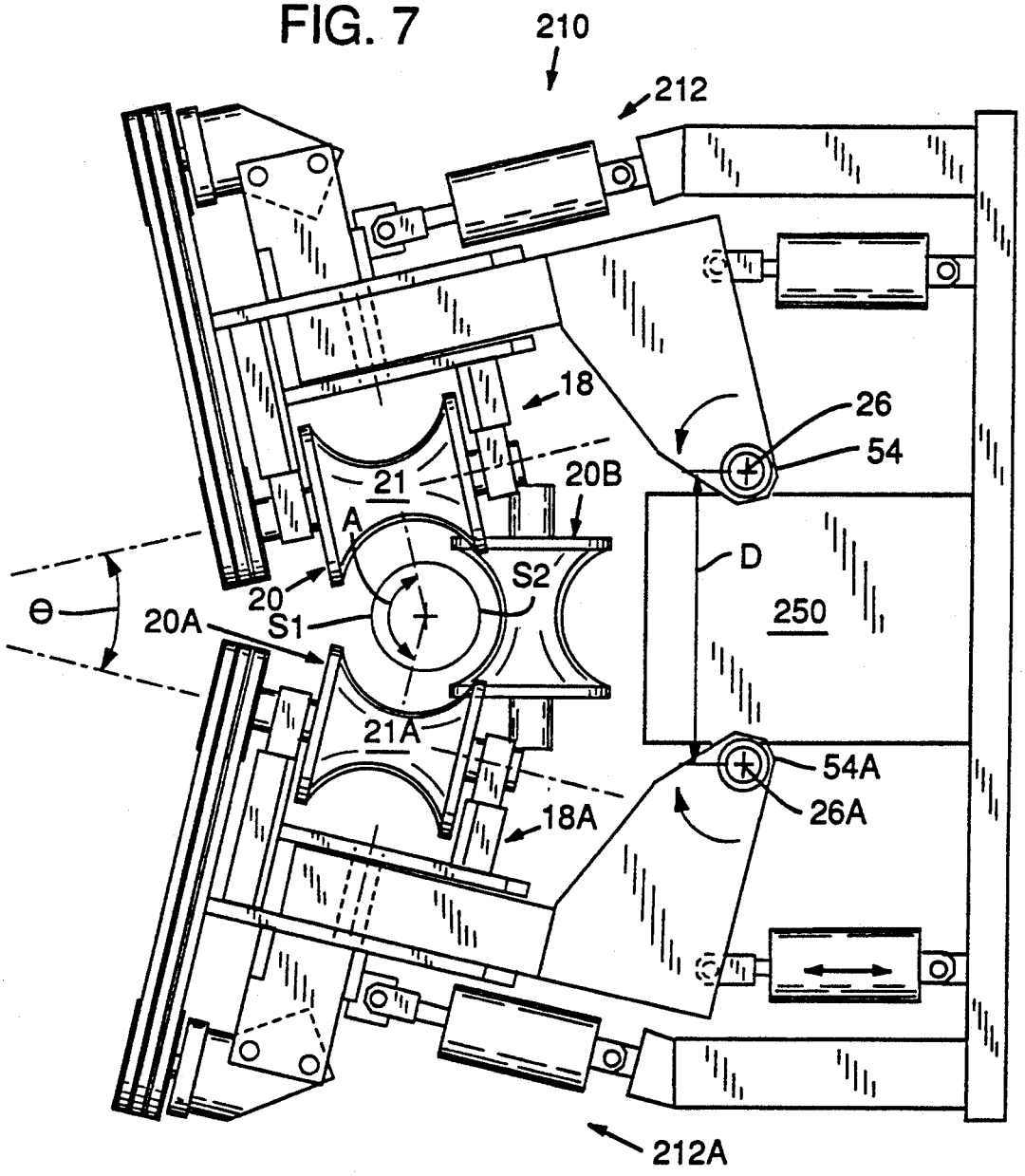
FIG. 7 is an elevation view, similar to FIG. 2, showing an alternative embodiment of debarker according to the invention which employs three cutter assemblies.

FIG. 7 shows an alternative, three-cutter debarker 210 according to the invention. This embodiment employs a pair of subassemblies 212, 212A. Each subassembly is structured and operable similarly to subassemblies 12, 12A described above, so like reference numerals are used to denote like parts. The key difference is that the support frame (details not shown) includes a mounting structure 250 added to the support frame (not shown) for supporting pivot members 54, 54A. The mounting structure 250 can be either mounted on a boom or fixedly mounted, depending on the application. If the mounting structure is mounted on a boom, the mounting structure 250 includes an adjustable receptacle (not shown) which can be adjusted to accommodate a variety of boom sizes. The supporting pivot members 54, 54A are spaced to position pivot axes 26, 26A at a distance D greater than the corresponding distance in the FIG. 2 embodiment.

This arrangement tilts the subassemblies 212, 212A toward one another but also spaces the farther apart than in the FIG. 2 embodiment. The resulting maximum diameter spacing of the cutter elements 20, 20A is the same but their angular position is asymmetrical about the log. The centers of the cutting surfaces 21, 21A are no longer diametrically opposed when rams 48, 48A are retracted. Instead, the axes of elements 20, 20A are skewed at an angle $\theta$ with respect to parallel, resulting in an angle A, e.g., 150 degrees between the cutting surfaces. The cutting surfaces are thereby offset toward one side S1 of the log. When smaller logs are debarked, the cutter elements are moved toward one another and rotated as described above for the first embodiment.

To debark an opposite side S2 of the log, a third cutter element 20B is mounted to span side S2 at a position spaced axially along the log so as not to interfere with elements 20, 20A. Details of the subassembly for supporting and driving element 20B are not shown, for clarity. Such subassembly can be the same as subassembly 20, or can be simplified, for example to move translationally toward and away from logs of different sizes.

The second embodiment has two advantages: it is less costly and does not weigh as much as the first embodiment. The tradeoff, however, is that it can leave some residual bark, which may not be acceptable in all applications.

Having described and illustrated the principles of the invention in a preferred embodiment and variations thereof, it should be apparent that the invention can be modified in arrangement and detail without departing from such principles. We claim all modifications and variation coming within the spirit and scope of the following claims.

We claim:

1. A high speed log debarker for debarking a lengthwise-moving log comprising;

a pair of debarking subassemblies including a pair of cylindrically concave, rotating cutter elements positioned angularly asymmetrically toward one side of the log and away from an opposite side thereof;

the cutter elements each having a cutting surface, formed with a cylindrical radius of concavity about an axis of rotation of the cutter element, defining a maximum diameter of log that can be debarked;

means for moving one of the cutter elements toward and away from the other cutter element to adapt to different log diameters; and means for pivoting each of the cutter elements about a pivoting axis normal to their axes of rotation so that the cutter elements can nest within one another when moved toward one another; and a third debarking subassembly including a cutter element positioned to debark said opposite side of the log.

2. A debarker according to claim 1 in which the pivoting axis is positioned to intersect a central axis of the log as the log passes lengthwise through the cutter elements so that the cutting surfaces define an oval of lesser diameter than said maximum diameter of log.

3. A debarker according to claim 1 including two sets of said pair of debarking subassemblies, arranged coaxially along the lengthwise-moving log so that each cutter element debarks a different quadrant of each log.

4. A debarker according to claim 1 including two sets of said pair of debarking subassemblies, each mounted swingably on opposite sides of a support frame so as to be positionable either coaxially along a log infeed path for debarking a log or out of the log infeed path for maintenance.

5. A debarker according to claim 1 in which the cutting surface of the cutter elements is formed by cutter knives or abrasion bars positioned in accordance with said cylindrical radius of concavity.

6. A debarker according to claim 1 including drive means for counterrotating the cutter elements.

7. A high speed log debarker for debarking a lengthwise-moving log comprising;

a pair of debarking subassemblies including a pair of cylindrically concave, rotating cutter elements positioned angularly asymmetrically toward one side of the log and away from an opposite side thereof and a third debarking subassembly including a cutter element positioned to debark said opposite side of the log;

the cutter elements each having a cutting surface, formed with a cylindrical radius of concavity about an axis of rotation of the cutter element, defining a maximum diameter of log that can be debarked;

the cutter assembly being pivotably mounted on the head platform to pivot the cutter element about a pivot axis normal to and intersecting the axis of the log and thereby skew the rotational axis of the concave cutting surface to a reduced effective radius of concavity in a plane normal to the log axis for debarking a smaller diameter log;

the head platform including first actuation means for moving the cutter element toward or away from the log to adapt to different log diameters;

second actuation means for pivoting the cutter element about the pivot axis responsive to movement of the head platform.

8. A debarker assembly according to claim 7 in which the cutter element is formed so as to debark a quadrant of the log.

9. A debarker assembly according to claim 7 in which the cutting surface of the cutter elements is formed by cutter knives or abrasion bars positioned in accordance with said cylindrical radius of concavity.

10. A debarking assembly according to claim 7 in which the cutter assembly includes a pivot member journaled in the head platform and an angularly movable platform mounted on the pivot member and supporting the cutter element and a drive means for rotating the cutter element.

11. A high speed method for debarking lengthwise-moving logs including logs which taper to very small diameters, the method comprising:

forming first, second, and third cylindrically concave cutter elements, each with a cutting surface having a cylindrical radius of concavity about an axis of rotation of the cutter element, defining a maximum diameter of log that can be debarked, the first and second cutter elements forming a pair of cutter elements;

positioning the pair of cutter elements angularly asymmetrically toward one side of the log and away from an opposite side thereof;

positioning the third cutter element opposed to the opposite side of the log to debark said opposite side of the log;

rotating the cutter elements;

moving the cutter elements toward or away from one another to adapt to differences in log diameter; and pivoting each of the first and second cutter elements about a pivoting axis normal to their axes of rotation and intersecting an axis of the log so that the cutter elements define an oval of a diameter less than said maximum diameter of log.

12. A debarking method according to claim 11 in which the pivoting step includes pivoting each of the first and second cutter elements in opposite directions so that the cutting surfaces of the cutter elements nest within one another when moved toward one another.

13. A debarking method according to claim 11 in which the cutter elements in the pair are rotated in opposite directions.

* * * * *